United States Patent [19]

Ewers et al.

[11] 4,157,733

[45] Jun. 12, 1979

[54] DUAL PUMP SYSTEM FOR FIRE FIGHTING VEHICLES

[75] Inventors: Ronald L. Ewers; John L. Oakley, both of Ocala, Fla.

[73] Assignee: Emergency One, Inc., Ocala, Fla.

[21] Appl. No.: 820,725

[22] Filed: Aug. 1, 1977

[51] Int. Cl.[2] ..... A62C 27/00

[52] U.S. Cl. ..... 169/24

[58] Field of Search ..... 417/319; 169/13, 24

[56] References Cited

U.S. PATENT DOCUMENTS

| | | | |
|---|---|---|---|
| 1,010,158 | 11/1911 | Lent | 169/24 |
| 2,112,651 | 3/1938 | Fox | 169/24 |
| 2,207,575 | 7/1940 | Boyles et al. | 169/24 X |
| 2,223,592 | 12/1940 | Barton et al. | 169/24 X |
| 2,468,008 | 4/1949 | Yocum | 169/24 X |
| 2,543,564 | 2/1951 | Bakewell | 417/319 X |
| 2,804,826 | 9/1957 | Cilker | 169/24 X |
| 2,874,786 | 2/1959 | Cilker | 169/24 |

*Primary Examiner*—John J. Love
*Attorney, Agent, or Firm*—Beaman & Beaman

[57] ABSTRACT

A pumping system for fire fighting vehicles wherein a pair of power take-off units mounted on the vehicle transmission engages with a drive gear within the transmission to separately drive water pumps. The power take-offs are each provided with a clutch wherein selective independent and simultaneous pump operation is possible, and it is also possible to operate one or both of the pumps while the vehicle is moving wherein a "pump and roll" capacity is achieved. The vehicle includes a water storage tank selectively communicating with an inlet manifold communicating with the pump inlets, and an outlet manifold receives the pumps' discharge. The manifolds are provided with hose fittings at each vehicle lateral side, and the two pump system of the invention is readily installable in medium size vehicles.

4 Claims, 5 Drawing Figures

DUAL PUMP SYSTEM FOR FIRE FIGHTING VEHICLES

BACKGROUND OF THE INVENTION

The invention pertains to pumping systems for vehicles of the fire engine or fire fighting type.

Fire fighting vehicles commonly known as "pumpers" include one or more water pumps selectively driven by the vehicle engine, and it is common for such vehicles to include a water supply tank, suction hose fittings, and pressure hose fittings. The pumps may be selectively supplied from the vehicle tank, or from a suction hose attached to a hydrant or in communication with another water source. It has long been known to mount a plurality of pumps on a vehicle in selective driven engagement with the vehicle engine, such as shown in U.S. Pat. Nos. 1,010,158; 2,223,592 and 2,804,826, and a plurality of pumps may be used to increase the pumping capacity of the vehicle, or if the pumps are connected in series a higher pressure can be produced than may be possible with a single pump. In such multiple pump installations a single power take-off or drive system is usually used with both pumps and selective operation of one or both pumps is not available.

While the versatility of a two-pump vehicle mounted pumping system wherein the pumps may be driven individually or simultaneously has been appreciated in the prior art as represented in U.S. Pat. No. 2,112,651 such known arrangements have utilized special transmission members, are complicated and expensive, and require substantial space for installation, and apparatus of the type disclosed in this patent is not compatable with modern fire fighting vehicle construction and design.

BRIEF DESCRIPTION OF THE INVENTION

It is an object of the invention to provide a dual pump system for fire fighting vehicles wherein dual water pumps of identical capacity may be concisely installed within a vehicle without requiring extensive space, and wherein pump operation may be individual or simultaneous, and the desired pump operation may be produced whether the vehicle is stationary or is being propelled.

It is a further object of the invention to produce a pumping capacity for fire fighting vehicles having much lower engine torque requirements to produce a given pumping capacity by the use of a pair of pumps as compared with a single pump system. For instance, in the practice of the invention the torque requirements to produce 500 gallons per minute pumping capacity is 210 lb. ft. while to produce a similar 500 GPM capacity with single pump 500 lb. ft. of torque would be required.

An additional object of the invention is to provide a dual pump system for fire fighting vehicles wherein the vehicle transmission includes a drive gear controlled by the vehicle clutch and a pair of power take-off units mounted upon the transmission housing engage with the drive gear to provide selective operation of two water pumps mounted upon the vehicle. Each of the power take-off units includes clutch means for engaging and disengaging the drive train through the power take-off whereby the pumps may be individually or simultaneously powered, and the power take-off drive gear does not interfere with the vehicle transmission and propelling thereof such that the desired pump operation can be achieved regardless of whether the vehicle is stationary or in motion.

It is a further object of the invention to provide a dual pump system for fire fighting vehicles wherein drive shaft failure to one of the pumps will not terminate the pumping capacity of the vehicle, but rather a 50% pumping capacity may be maintained.

Another object of the invention is to provide a dual pump system for fire fighting vehicles wherein the space required for the pump system is approximately two-thirds of that occupied by pump systems of comparable capacity, the cost of a pump system in accord with the invention being approximately 75% of the cost of a comparable capacity pump system utilizing conventional pumps, and the weight of a pump system in accord with the invention is approximately 10% lighter than a conventional comparable capacity pumping system.

In the practice of the invention a fire fighting vehicle utilizing a motor, a transmission, and a clutch interposed between the motor and transmission employs a power take-off drive gear in the transmission which will be rotating during engine operation except when the clutch is disengaged. Thus, the drive gear will be rotating while the vehicle is being propelled, and will also be rotating while the vehicle is stationary and the engine operating. A pair of centrifical water pumps are mounted upon the vehicle each including a drive shaft connected to a power take-off unit. The power take-off units are each mounted upon the vehicle transmission, and include gearing which meshes with the transmission drive gear. Also, each power take-off unit includes a clutch means wherein the associated pump drive shaft may be selectively engaged or disengaged with respect to the transmission drive gear. In this manner the pumps may be operated individually or simultaneously, while the vehicle is at rest or in motion.

The vehicle includes a water supply tank which communicates through a valve with a pump inlet manifold of an elongated form which extends transversely of the vehicle length. The ends of the intake manifold are provided with suction hose fittings located at the vehicle lateral sides, and these fittings include valves or caps whereby the inlet manifold may be selectively supplied with water from the vehicle supply tank or a suction hose or hoses.

The outlet of the pumps commonly communicate with an outlet manifold of an elongated configuration which also extends transversely with respect to the vehicle length having pressure hose fittings at each manifold end whereby the pressure hoses may be attached at the outlet manifold on either or both vehicle sides, and as both pump outlets communicate with the outlet manifold pressurized water will be supplied at a pressurized fitting regardless of whether one or both pumps are in operation.

The power transmission for the pumps, and the vehicle transmission, permits one or two of the vehicle pumps to be operated while the vehicle is in motion providing a "pump and roll" capacity which is particularly useful when fighting grass fires and the like. However, by merely placing the vehicle transmission shift lever in "neutral" one or both pumps will be capable of operation while the vehicle is at rest, as is used when pumping water upon a stationary object.

BRIEF DESCRIPTION OF THE DRAWINGS

The aforementioned objects and advantages will be apparent from the following description and accompanying drawings wherein.

DESCRIPTION OF THE PREFERRED EMBODIMENT

Figure 1:
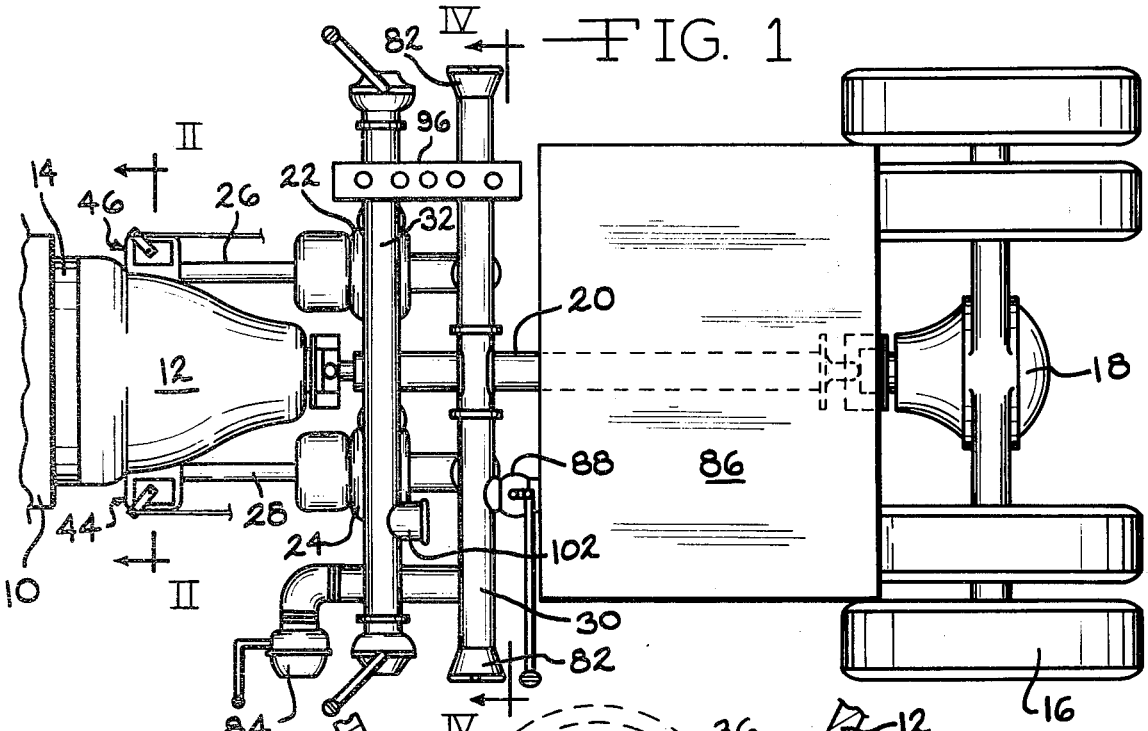
FIG. 1 is a plan view of a portion of a fire fighting vehicle utilizing the apparatus of the invention.

Basic components of a fire fighting vehicle in accord with the invention are illustrated in FIG. 1 wherein the vehicle includes an internal combustion engine 10 driving a transmission 12 through a conventional clutch within clutch housing 14. The vehicle includes rear drive wheels 16 mounted upon a rear axle including differential 18, and the differential is driven by the transmission output through shaft 20. Usually, the transmission 12 will be of the manual, multi-speed type, but it is within the concept of the invention that the transmission be of the automatic variety.

The vehicle also includes water pumps 22 and 24, the pumps being mounted upon opposite sides of the drive shaft 20, and pump 22 includes a drive shaft 26, while pump 24 includes a drive shaft 28, the pump drive shafts being substantially parallel to the vehicle drive shaft, and extending in a forward direction from the associated pump. The plumbing associated with the pumps includes an inlet manifold 30, and an outlet manifold 32, both manifolds being mounted transversely across the vehicle and having ends located adjacent the vehicle lateral sides, as will be described.

The transmission 12 is substantially conventional, and includes a rotating shaft 34 which will rotate at all times that the engine 10 is operating except when the clutch within clutch housing 14 is disengaged from the engine. Therefore, it is to be understood that the shaft 34 will rotate regardless of whether the vehicle wheels 16 are being driven, or the vehicle is stationary, as long as the transmission clutch is engaging the engine output and the engine is operating.

Figure 2:
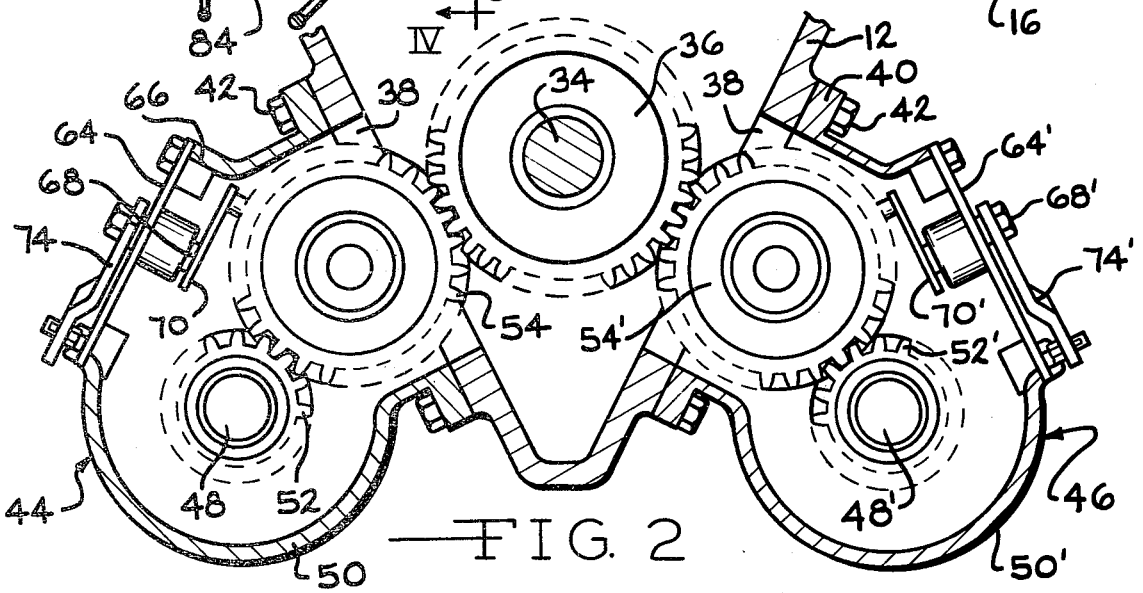
FIG. 2 is an elevational, sectional, view of the vehicle transmission as taken along Section II—II of FIG. 1.
Figure 3:
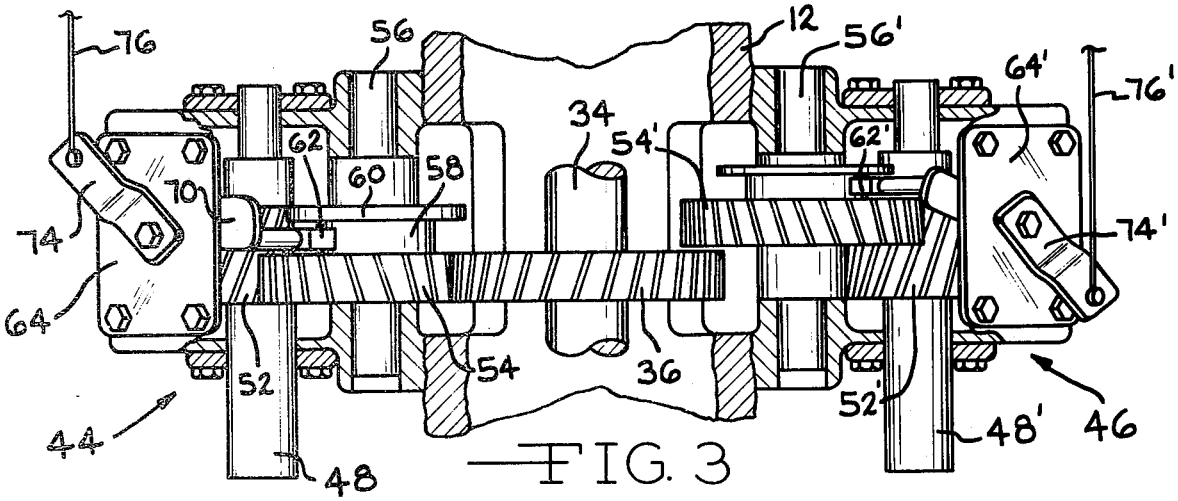
FIG. 3 is a plan partially sectional view of the transmission of FIG. 2.

A third speed counter-gear 36 is mounted upon the shaft 34, and the gear 36 is in alignment with openings 38 defined in the transmission casing, FIGS. 2 and 3. The openings 38 constitute power take-off openings, and the transmission casing includes bosses 40 about the openings which are drilled and tapped for receiving bolts 42 for the attachment of power take-off units to the casing in alignment with gear 36.

A power take-off unit is fastened to each side of the transmission casing, and the power take-offs are generally indicated at 44 and 46. The power take-offs are similar in construction, being of right hand and left hand construction, and the following description will be with respect to power take-off unit 44, similar components of unit 46 being indicated by primed reference numeral.

The power take-off 44 includes an output shaft 48 rotatably mounted within suitable bearings upon the casing 50, the output shaft being substantially parallel to the vehicle length, and an output gear 52 is mounted upon the output shaft and is of an axial length approximately twice that of the gear 36, as will be appreciated from FIG. 3.

A transfer gear 54 is mounted within casing 50 upon rotatable shaft 56, and the teeth of the transfer gear mesh with the teeth of output gear 52. The transfer gear 54 is axially slidably displaceable upon the shaft 56, and includes a groove 58 defined by the gear and flange 60 for receiving the shifting yoke 62, as will be later described. The teeth of the transfer gear 54 are selectively engageable with the teeth of the transmission drive gear 36, and in FIG. 3 transfer gear 54' is illustrated as being out of mesh with the teeth of drive gear 36, while transfer gear 54 is shown as meshing with the drive gear 36.

A cover plate mounted upon the power take-off casing by bolts cover the opening 66, and serves as the support for the rotatable shifting shaft 68. The inner end of the shaft 68 includes a lever 70 and the yoke 62 which is received within the associated transfer gear groove 58, and the outer end of the shaft 68 has the shifting lever 74 fixed thereon whereby oscillation of the shifting lever rotates shaft 68 and positions yoke 62 to axially displace the associated transfer gear 54 with respect to the drive gear 36.

The lever 74, shaft 68, yoke 62 and transfer gear 54 all form a part of clutch structure for the associated power take-off unit 44 whereby the power take-off output shaft 48 may be selectively driven by the transmission shaft 34 and gear 36.

The shifting levers 74 and 74' are operated remotely through rods or cables 76 and 76' attached thereto, and actuating means for the rods and cables are located upon the vehicle adjacent an appropriate control panel or console, as is well known in the fire fighting vehicle art.

The power take-off output shaft 48 is directly connected to the pump drive shaft 28, and the power take-off output shaft 48' is directly connected to the pump drive shaft 26. Of course, the location of the pumps on the vehicle may necessitate the utilization of universal joints in the drive train between the pumps and the associated power take-off unit, but it is to be appreciated that each pump is directly connected to a separate power take-off unit and the pump operation is controlled by the associated power take-off unit.

Figure 5:
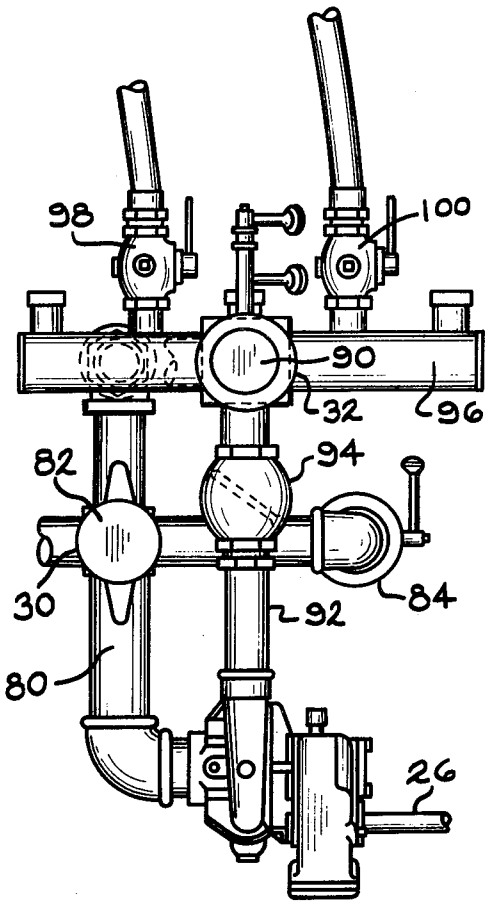
FIG. 5 is an elevational view of the structure of FIG. 4 as taken from the right side thereof.
Figure 4:
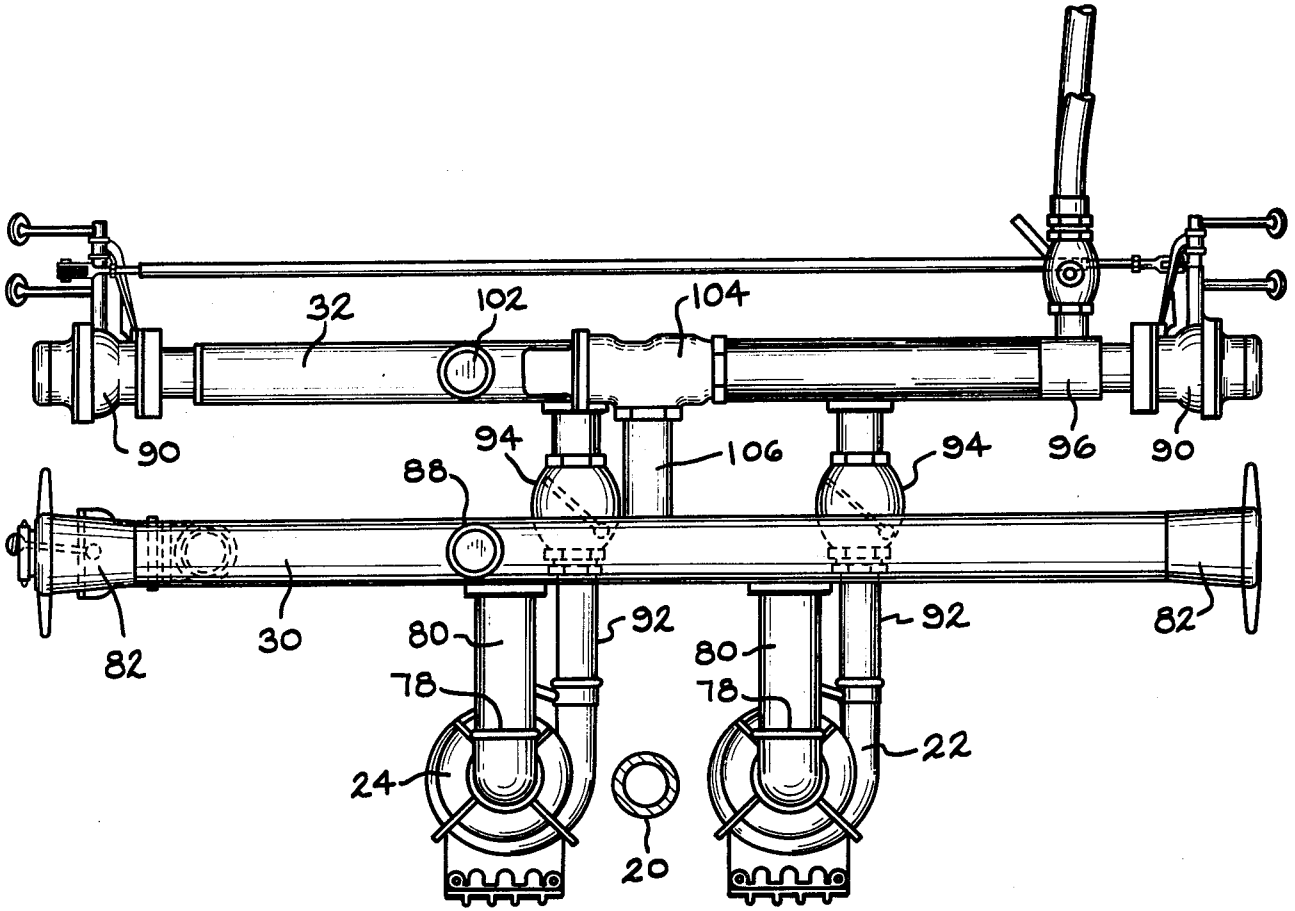
FIG. 4 is an enlarged, detail, sectional view of the pumps and manifolds as taken along Section IV—IV of FIG. 1.

The plumbing associated with the pumps 22 and 24 is best illustrated in FIGS. 4 and 5, and as previously described, includes an inlet manifold 30, and an outlet manifold 32. Each pump includes an inlet port 78 to which an inlet conduit 80 is attached, and the inlet conduits 80 each communicate with the inlet manifold. The inlet manifold 30 extends transversely across the width of the vehicle, and at each end includes a fitting 82 for receiving a suction hose. The fittings 82 normally close the associated end of the inlet manifold, and an auxiliary valved suction fitting 84 communicates with the inlet manifold whereby an additional suction hose may be attached thereto, if desired.

The vehicle also includes a water storage tank 86, FIG. 1, and the water storage tank includes a valved outlet 88 communicating with the inlet manifold 30 whereby water may be supplied to the pumps from the tank 86 if the water supply of the vehicle is to be utilized.

The outlet manifold 32 also extends transversely of the vehicle length, and includes a valved discharge fitting 90 at each end. The outlet manifold is supplied with pressurized water from the pump outlets through conduits 92 and check valves 94. A hose manifold 96 communicates with the outlet manifold, and valves 98 and 100 are illustrated as mounted thereon in communication with the hose manifold, the hose on valve 98 communicating with the tank of the vehicle to permit filling, and the hose on valve 100 providing the supply to the vehicle hose reel. Additional connections are defined upon the hose manifold, and a fitting 102 communicating with the outlet manifold 32 extends rearwardly for attachment to a rear discharge, if desired.

The outlet manifold also includes a relief valve 104 which communicates with conduit 106 connected to inlet manifold 30 whereby water will be recirculated when the pumps are operating, and the valves associated with the outlet manifold are closed.

The aforedescribed structure permits each of the pumps 22 and 24 to be individually driven by the gear 36 within transmission 12. Either pump may be energized or deactivated, and merely by operating the control cables 76 complete individual control of the pumps is achieved. As the drive gear 36 is located within the regular transmission 12 additional expensive transmission gearing is not required, and the described plumbing connections permit the desired individual pump operation without creating air locks or other disabling conditions.

While each pump 22 and 24 is rated at 250 gallons per minute, the torque requirement for operating both pumps to produce a 500 gpm output is 210 ft lb., as compared with apparatus using a single 500 gpm pump which requires 500 ft. lb. of torque.

Further advantages of the invention are derived from the ability of the system to be concisely installed upon the vehicle as compared with single pump systems of equal pumping capacity. As the inlet manifold may be directly supplied from the vehicle tank 86, either one or both pumps may be supplied with water while the vehicle is in motion, and such "pump and roll" capacity is highly desirable when the vehicle is used with grass or forest fires.

The apparatus permits pumping capacity even in the event that the drive train from the transmission to the differential fails, and should a pump drive shaft failure occur the disengagement of that pump from the transmission still permits the other pump to operate wherein the apparatus will still remain at a 50% capacity, an advantage not achieved with the usual fire fighting vehicle pumping system employing a single power take-off and pump driving system. The apparatus in accord with the invention, as compared with more conventional vehicle pumping systems of equivalent capacity, occupies only two-thirds of the space, is only three-quarters as expensive, and is approximately 10% lighter in weight than a comparable 500 gpm system.

It is appreciated that various modifications to invention may be apparent to those skilled in the art without departing from the spirit and scope thereof.

We claim:

1. A dual pump system for fire fighting vehicles characterized by its low torque requirements to produce a given pumping capacity, ability to pump during vehicle travel, and concise installation comprising, in combination, a vehicle including drive wheels, an engine drivingly connected to said drive wheels through a clutch and transmission mounted within a transmission casing, said transmission including power take-off drive gear means within said casing continuously rotatably driven by said engine during clutch engagement, first and second water pumps mounted upon said vehicle each having an inlet, an outlet and a drive shaft, first and second power take-offs mounted on said transmission casing each in selective driven engagement with said drive gear means and each having an output shaft, first clutch means selectively connecting said drive gear means to said drive shaft of said first pump through said first power take-off, and second clutch means selectively connecting said drive gear means to said drive shaft of said second pump through said second power take-off whereby said first and second pumps may be selectively operated individually or simultaneously and during driving of said drive wheels by said engine and transmission.

2. In a dual pump system for vehicles as in claim 1, a water supply tank mounted upon said vehicle having an outlet, a valve controlling flow through said supply tank outlet, a pump inlet manifold mounted on said vehicle communicating with said valve for selectively receiving water from said supply tank, said pump inlets communicating with said inlet manifold.

3. In a dual pump system for vehicles as in claim 1, wherein said power take-off drive gear means comprises a single drive gear within said transmission casing, said power take-offs each including an output gear fixed to each output shaft, and clutch means including a transfer gear axially displacable between an operative position meshing with said drive gear and associated output gear and an inoperative position disengaged from said drive gear, and transfer gear operating means for selectively shifting said transfer gear between said operative and inoperative positions, said first pump drive shaft being connected to said output shaft of said first power take-off and said second pump drive shaft being connected to said output shaft of said second power take-off.

4. In a dual pump system for vehicles as in claim 3, wherein said transfer gear operating means comprises a manually operable lever pivotally mounted upon each power take-off, said levers each including a yoke operably engaging the associated transfer gear for axial displacement thereof during pivoting of said levers.

* * * * *